US009965992B2

(12) United States Patent
Kim

(10) Patent No.: US 9,965,992 B2
(45) Date of Patent: May 8, 2018

(54) DISPLAY DEVICE

(71) Applicant: Samsung Display Co., Ltd., Yongin-si, Gyeonggi-do (KR)

(72) Inventor: Dong-Gyu Kim, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 401 days.

(21) Appl. No.: 14/869,888

(22) Filed: Sep. 29, 2015

(65) Prior Publication Data

US 2016/0225304 A1 Aug. 4, 2016

(30) Foreign Application Priority Data

Feb. 2, 2015 (KR) ..... 10-2015-0015899

(51) Int. Cl.
*G09G 3/32* (2016.01)
*G09G 3/20* (2006.01)
*G09G 3/36* (2006.01)

(52) U.S. Cl.
CPC ..... *G09G 3/2092* (2013.01); *G09G 3/3611* (2013.01); *G09G 3/3666* (2013.01); *G09G 2300/0426* (2013.01); *G09G 2310/0221* (2013.01); *G09G 2310/08* (2013.01)

(58) Field of Classification Search
CPC ... G09G 3/2092; G09G 3/2003; G09G 3/3233
USPC ..... 349/143, 160; 345/82, 213, 545, 690
See application file for complete search history.

(56) References Cited

U.S. PATENT DOCUMENTS

2011/0248965 A1* 10/2011 Suh ..... G09G 3/3225 345/204
2014/0300649 A1* 10/2014 Park ..... G09G 3/006 345/690
2017/0061849 A1* 3/2017 Matsueda ..... G09G 3/2003

FOREIGN PATENT DOCUMENTS

KR 10-2004-0094146 A 11/2004
KR 10-2006-0104848 A 10/2006
KR 10-2007-0037272 A 4/2007
KR 10-2007-0048345 A 5/2007
KR 10-2012-0019016 A 3/2012
KR 10-2014-0077359 A 6/2014
KR 10-2014-0080670 A 7/2014

* cited by examiner

*Primary Examiner* — Calvin C Ma
(74) *Attorney, Agent, or Firm* — Knobbe Martens Olson & Bear LLP

(57) ABSTRACT

A display device is disclosed. In one aspect, the display device includes a display panel and a scan driver configured to provide a plurality of scan signals to the display panel via a plurality of scan-lines. The scan signals include upper, lower, left and right scan signals. The scan-lines include first and second vertical scan-lines, and first and second horizontal scan-lines respectively arranged in upper and lower regions of the display panel. The display device also includes a data driver configured to provide a plurality of data signals to the display panel, and a timing controller configured to control the scan driver and data driver.

20 Claims, 9 Drawing Sheets

DISPLAY DEVICE

INCORPORATION BY REFERENCE TO ANY PRIORITY APPLICATIONS

This application claims priority under 35 USC § 119 to Korean Patent Application No. 10-2015-0015899, filed on Feb. 2, 2015 in the Korean Intellectual Property Office (KIPO), the contents of which are incorporated herein in its entirety by reference.

BACKGROUND

Field

The described technology generally relates to a display device.

Description of the Related Technology

Generally, an electronic device includes a display device for providing visual information to users. The display device includes a display panel, a scan driver, a data driver, a timing controller, etc. In typical display devices, a scan driving circuit (included in a scan driver) is located on the side of the display panel to provide a scan signal to the display panel via scan-lines. Here, a resistor-capacitor (RC) delay occurs as the scan signal is transferred to the other side of the display panel via the scan-lines. Thus, image quality can be degraded by a decline of a pixel response speed due to the RC delay of the scan signal.

To overcome this problem, some typical display devices include scan driving circuits at opposite (or both) sides (e.g., left and right sides or upper and lower sides) of the display panel so that the scan signal is provided locally. As the size of a display panel increases, the RC delay of the scan signal will naturally increase.

SUMMARY OF CERTAIN INVENTIVE ASPECTS

One inventive aspect relates to a display device that can minimize or reduce interference among scan-lines by efficiently arranging the scan-lines in a display panel when scan driving circuits of a scan driver are arranged at a left side, a right side, an upper side, and a lower side of the display panel to prevent an RC delay of a scan signal.

Another aspect is a display device that includes a display panel, a scan driver, a data driver, and a timing controller. Here, the scan driver can include an upper scan driving circuit located near an upper side of the display panel and configured to provide an upper scan signal to an upper region of the display panel via first vertical scan-lines, a lower scan driving circuit located near a lower side of the display panel and configured to provide a lower scan signal to a lower region of the display panel via second vertical scan-lines, a left scan driving circuit located near a left side of the display panel and configured to provide a left scan signal to the display panel via horizontal scan-lines, and a right scan driving circuit located near a right side of the display panel and configured to provide a right scan signal to the display panel via the horizontal scan-lines. In addition, the first vertical scan-lines can be connected to the horizontal scan-lines as a pair in a left-right symmetrical shape with respect to a left-right symmetry center line of the display panel in the upper region of the display panel. Furthermore, the second vertical scan-lines can be connected to the horizontal scan-lines as a pair in a left-right symmetrical shape with respect to the left-right symmetry center line of the display panel in the lower region of the display panel.

In example embodiments, a plurality of pixels located in the upper region of the display panel receive a scan signal including the upper scan signal, the left scan signal, and the right scan signal when a scan operation is performed on the upper region of the display panel.

In example embodiments, a plurality of pixels located in the lower region of the display panel receive a scan signal including the lower scan signal, the left scan signal, and the right scan signal when a scan operation is performed on the lower region of the display panel.

In example embodiments, contact points of the first vertical scan-lines and the horizontal scan-lines get farther from an upper-lower symmetry center line of the display panel as the contact points of the first vertical scan-lines and the horizontal scan-lines get farther from the left-right symmetry center line of the display panel in the upper region of the display panel.

In example embodiments, the first vertical scan-lines gradually get shorter as the first vertical scan-lines get farther from the left-right symmetry center line of the display panel.

In example embodiments, the first vertical scan-lines are arranged within a predetermined distance from the left-right symmetry center line of the display panel.

In example embodiments, a quantity of the first vertical scan-lines is twice as many as a quantity of the horizontal scan-lines arranged in the upper region of the display panel.

In example embodiments, contact points of the second vertical scan-lines and the horizontal scan-lines get farther from the upper-lower symmetry center line of the display panel as the contact points of the second vertical scan-lines and the horizontal scan-lines get farther from the left-right symmetry center line of the display panel in the lower region of the display panel.

In example embodiments, the second vertical scan-lines gradually get shorter as the second vertical scan-lines get farther from the left-right symmetry center line of the display panel.

In example embodiments, the second vertical scan-lines are arranged within a predetermined distance from the left-right symmetry center line of the display panel.

In example embodiments, a quantity of the second vertical scan-lines is twice as many as a quantity of the horizontal scan-lines arranged in the lower region of the display panel.

In example embodiments, the contact points of the first vertical scan-lines and the horizontal scan-lines are horizontally symmetrical to the contact points of the second vertical scan-lines and the horizontal scan-lines with respect to the upper-lower symmetry center line of the display panel in the display panel.

In example embodiments, contact points of the first vertical scan-lines and the horizontal scan-lines get closer to an upper-lower symmetry center line of the display panel as the contact points of the first vertical scan-lines and the horizontal scan-lines get farther from the left-right symmetry center line of the display panel in the upper region of the display panel.

In example embodiments, the first vertical scan-lines gradually get longer as the first vertical scan-lines get farther from the left-right symmetry center line of the display panel.

In example embodiments, the first vertical scan-lines are arranged within a predetermined distance from the left-right symmetry center line of the display panel.

In example embodiments, a quantity of the first vertical scan-lines is twice as many as a quantity of the horizontal scan-lines arranged in the upper region of the display panel.

In example embodiments, contact points of the second vertical scan-lines and the horizontal scan-lines get closer to the upper-lower symmetry center line of the display panel as the contact points of the second vertical scan-lines and the horizontal scan-lines get farther from the left-right symmetry center line of the display panel in the lower region of the display panel.

In example embodiments, the second vertical scan-lines gradually get longer as the second vertical scan-lines get farther from the left-right symmetry center line of the display panel.

In example embodiments, the second vertical scan-lines are arranged within a predetermined distance from the left-right symmetry center line of the display panel.

In example embodiments, a quantity of the second vertical scan-lines is twice as many as a quantity of the horizontal scan-lines arranged in the lower region of the display panel.

In example embodiments, the contact points of the first vertical scan-lines and the horizontal scan-lines are horizontally symmetrical to the contact points of the second vertical scan-lines and the horizontal scan-lines with respect to the upper-lower symmetry center line of the display panel in the display panel.

Another aspect is a display device that includes an upper scan driving circuit located near an upper side of a display panel, which provides an upper scan signal to an upper region of the display panel via first vertical scan-lines, a lower scan driving circuit located near a lower side of the display panel, which provides a lower scan signal to a lower region of the display panel via second vertical scan-lines, a left scan driving circuit located near a left side of the display panel, which provides a left scan signal to the display panel via horizontal scan-lines, and a right scan driving circuit located near a right side of the display panel, which provides a right scan signal to the display panel via the horizontal scan-lines. In the upper region of the display panel, the first vertical scan-lines can be connected to the horizontal scan-lines as a pair in a left-right symmetrical shape with respect to a left-right symmetry center line of the display panel. In the lower region of the display panel, the second vertical scan-lines can be connected to the horizontal scan-lines as a pair in a left-right symmetrical shape with respect to the left-right symmetry center line of the display panel.

Another aspect is a display device, comprising: a display panel; a scan driver configured to provide a plurality of scan signals to the display panel via a plurality of scan-lines, wherein the scan signals include upper, lower, left and right scan signals, and wherein the scan-lines include first and second vertical scan-lines, and first and second horizontal scan-lines respectively arranged in upper and lower regions of the display panel; a data driver configured to provide a plurality of data signals to the display panel; and a timing controller configured to control the scan driver and data driver. The scan driver includes: an upper scan driving circuit located adjacent to an upper side of the display panel and configured to provide the upper scan signal to an upper region of the display panel via the first vertical scan-lines; a lower scan driving circuit located adjacent to a lower side of the display panel and configured to provide the lower scan signal to a lower region of the display panel via the second vertical scan-lines; a left scan driving circuit located adjacent to a left side of the display panel and configured to provide the left scan signal to the display panel via the first and second horizontal scan-lines; and a right scan driving circuit located adjacent to a right side of the display panel and configured to provide the right scan signal to the display panel via the first and second horizontal scan-lines, wherein the first vertical scan-lines are connected to the first and second horizontal scan-lines and are symmetrical with respect to a left-right symmetry center line of the display panel, and wherein the second vertical scan-lines are connected to the first and second horizontal scan-lines and are symmetrical with respect to the left-right symmetry center line of the display panel.

In the above display device, the display panel includes a first group of pixels located in the upper region of the display panel and configured to receive the upper, left and right scan signals when a first scan operation is performed on the upper region of the display panel, wherein the display panel further includes a second group of pixels located in the lower region of the display panel and configured to receive the lower, left and right scan signals when a second scan operation is performed on the lower region of the display panel.

In the above display device, the intersection of the first vertical scan-lines and the first and second horizontal scan-lines form first contact points, wherein the first contact points are located farther from an upper-lower symmetry center line of the display panel as the first contact points are located farther from the left-right symmetry center line of the display panel.

In the above display device, the first vertical scan-lines become shorter as the first vertical scan-lines are located farther from the left-right symmetry center line of the display panel.

In the above display device, the first vertical scan-lines are located within a predetermined distance from the left-right symmetry center line of the display panel.

In the above display device, the number of the first vertical scan-lines is twice as many as the number of the first horizontal scan-lines.

In the above display device, the intersection of the second vertical scan-lines and the first and second horizontal scan-lines form second contact, wherein the second contact points are located farther from the upper-lower symmetry center line of the display panel as the second contact points are located farther from the left-right symmetry center line of the display panel.

In the above display device, the second vertical scan-lines become shorter as the second vertical scan-lines are located farther from the left-right symmetry center line of the display panel.

In the above display device, the second vertical scan-lines are located within a predetermined distance from the left-right symmetry center line of the display panel.

In the above display device, the number of the second vertical scan-lines is twice as many as the number of the second horizontal scan-lines.

In the above display device, the first and second contact points are symmetrical to each other with respect to the upper-lower symmetry center line of the display panel.

In the above display device, the intersection of the first vertical scan-lines and the first and second horizontal scan-lines form first contact points, wherein the first contact points are located closer to an upper-lower symmetry center line of the display panel as the first contact points are located farther from the left-right symmetry center line of the display panel.

In the above display device, the first vertical scan-lines become longer as the first vertical scan-lines are located farther from the left-right symmetry center line of the display panel.

In the above display device, the first vertical scan-lines are located within a predetermined distance from the left-right symmetry center line of the display panel.

In the above display device, the number of the first vertical scan-lines is twice as many as the number of the first horizontal scan-lines.

In the above display device, the intersection of the second vertical scan-lines and the first and second horizontal scan-lines form second contact points, wherein the second contact points are located closer to the upper-lower symmetry center line of the display panel as the second contact points are located farther from the left-right symmetry center line of the display panel.

In the above display device, the second vertical scan-lines are formed longer as the second vertical scan-lines are located farther from the left-right symmetry center line of the display panel.

Another aspect is a display device, comprising: a display panel; a scan driver configured to provide a plurality of scan signals to the display panel via a plurality of scan-lines, wherein the scan signals include upper, lower, left and right scan signals, and wherein the scan-lines include first and second vertical scan-lines and horizontal scan-lines; a data driver configured to provide a plurality of data signals to the display panel; and a timing controller configured to control the scan driver and data driver. The scan driver includes: a first scan driving circuit configured to provide the upper scan signal to an upper region of the display panel via the first vertical scan-lines; a second scan driving circuit configured to provide the lower scan signal to a lower region of the display panel via the second vertical scan-lines; a third scan driving circuit configured to provide the left scan signal to the display panel via the horizontal scan-lines; and a fourth scan driving circuit configured to provide the right scan signal to the display panel via the horizontal scan-lines, wherein the first vertical scan-lines are connected to the horizontal scan-lines and are symmetrical with respect to a left-right symmetry center line of the display panel, and wherein the second vertical scan-lines are connected to the horizontal scan-lines and are symmetrical with respect to the left-right symmetry center line of the display panel.

In the above display device, the first to fourth scan driving circuits respectively include upper, lower, left and right scan driving circuits.

In the above display device, the first scan driving circuit is located adjacent to an upper side of the display panel, wherein the second scan driving circuit is located adjacent to a lower side of the display panel, wherein the third scan driving circuit is located adjacent to a left side of the display panel, and wherein the fourth scan driving circuit is located adjacent to a right side of the display panel.

According to at least one of the disclosed embodiments, the display device minimizes or reduces interference among the scan-lines as well as prevent an RC delay of the scan signal provided via the scan-lines by efficiently arranging the scan-lines in the display panel.

DETAILED DESCRIPTION OF CERTAIN INVENTIVE EMBODIMENTS

Some display devices include scan driving circuits at all sides (e.g., left, right, upper, and lower sides) of the display panel. In this case, interference (e.g., noise, etc.) can occur among the scan-lines because of the complex arrangement of the scan-lines.

Hereinafter, the described technology will be explained in detail with reference to the accompanying drawings. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
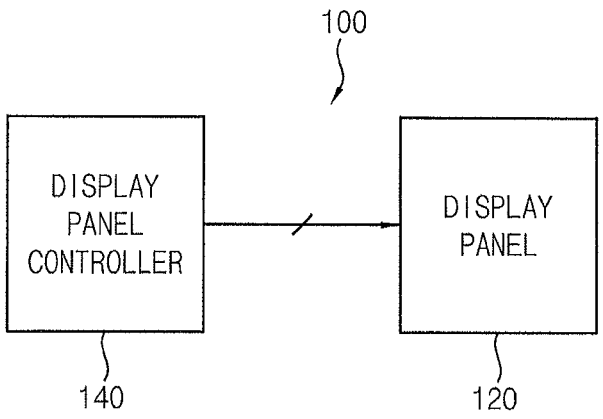
FIG. 1 is a block diagram illustrating a display device according to example embodiments.
Figure 2:
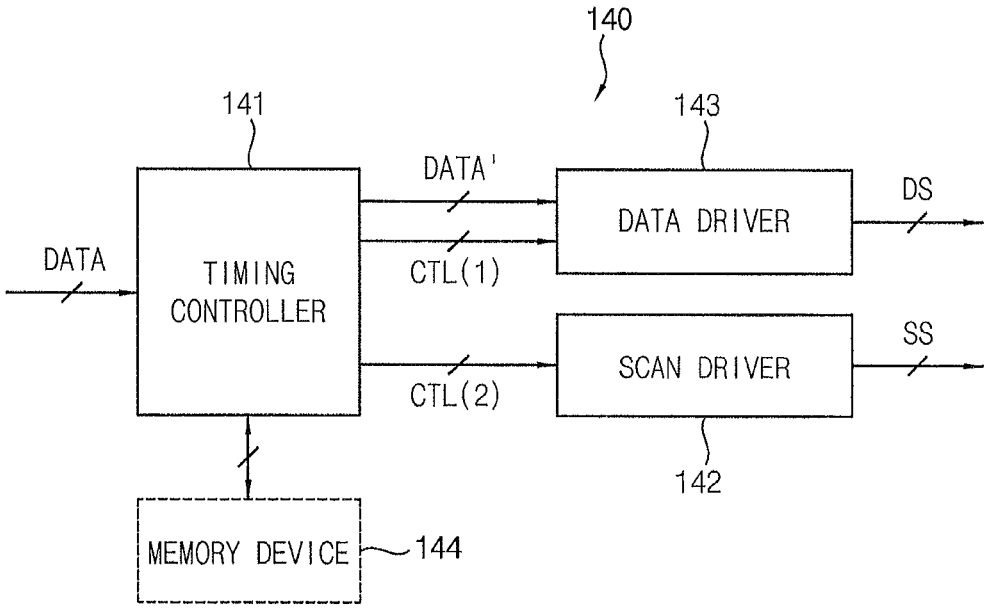
FIG. 2 is a block diagram illustrating a display panel controller of the display device of FIG. 1.
Figure 3:
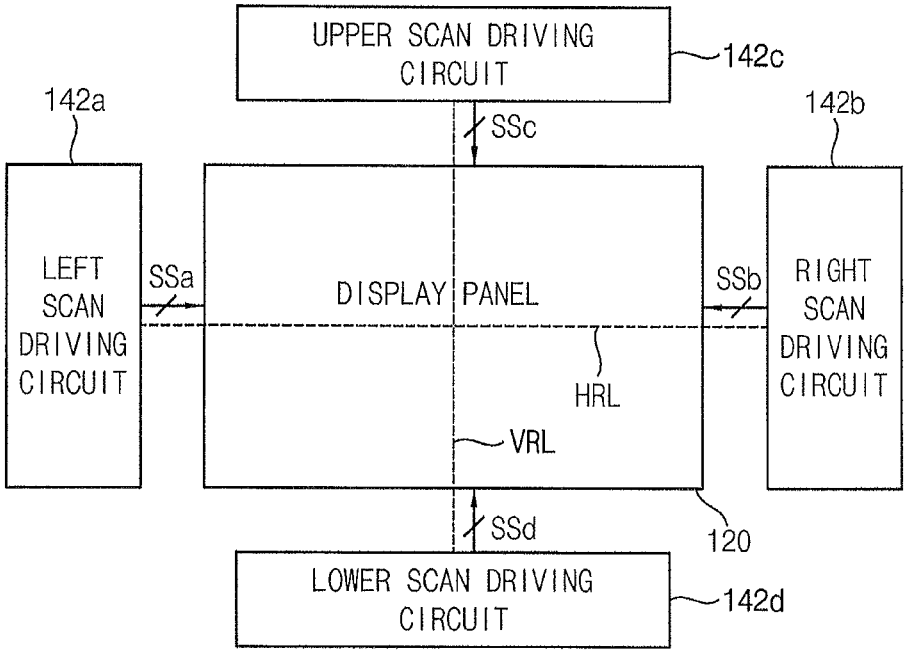
FIG. 3 is a block diagram illustrating an example in which a scan driver is arranged adjacent to a display panel in the display device of FIG. 1.

FIG. 1 is a block diagram illustrating a display device according to example embodiments. Depending on embodiments, certain elements may be removed from or additional elements may be added to the display device 100 illustrated in FIG. 1. Furthermore, two or more elements may be combined into a single element, or a single element may be realized as multiple elements. This applies to the remaining apparatus embodiments. FIG. 2 is a block diagram illustrating a display panel controller of the display device of FIG. 1. FIG. 3 is a block diagram illustrating an example in which a scan driver is arranged adjacent to a display panel in the display device of FIG. 1.

Referring to FIGS. 1 through 3, the display device 100 includes a display panel 120 that displays an image and a display panel controller 140 that drives the display panel 120. In addition, as illustrated in FIG. 2, the display panel controller 140 can include a timing controller 141, a scan driver 142, a data driver 143, etc. In some example embodiments, the display panel controller 140 further includes a memory device 144. The display device 100 can be a liquid crystal display or an organic light-emitting diode (OLED) display. However, the display device 100 is not limited thereto. In some example embodiments, the display device 100 further includes other components.

The display panel 120 can include a plurality of pixels. The display panel 120 can be connected to the scan driver 142 of the display panel controller 140 via horizontal scan-lines, first vertical scan-lines, and second vertical scan-lines. As illustrated in FIG. 3, the scan driver 142 includes a left scan driving circuit 142*a* arranged near a left side of the display panel 120, a right scan driving circuit 142*b* arranged near a right side of the display panel 120, an upper scan driving circuit 142*c* arranged near an upper side of the display panel 120, and a lower scan driving circuit 142*d* arranged near a lower side of the display panel 120. The left scan driving circuit 142*a* can provide a left scan signal SSa to the display panel 120 via the horizontal scan-lines. The right scan driving circuit 142*b* can provide a right scan signal SSb to the display panel 120 via the horizontal scan-lines. The upper scan driving circuit 142*c* can provide an upper scan signal SSc to the display panel 120 via the first vertical scan-lines. The lower scan driving circuit 142*d* can provide a lower scan signal SSd to the display panel 120 via the second vertical scan-lines. In example embodiments, the display panel 120 is divided into a left region and a right region by a left-right symmetry center line VRL of the display panel 120, and the display panel 120 is divided into an upper region and a lower region by a upper-lower symmetry center line HRL of the display panel 120. In the upper region of the display panel 120, the first vertical scan-lines can be connected to the horizontal scan-lines as a pair in a left-right symmetrical shape with respect to the left-right symmetry center line VRL of the display panel 120. In the lower region of the display panel 120, the second vertical scan-lines can be connected to the horizontal scan-lines as a pair in a left-right symmetrical shape with respect to the left-right symmetry center line VRL of the display panel 120.

As described above, the display panel 120 can receive a scan signal SS from the scan driver 142. That is, the display panel 120 can receive the left scan signal SSa, the right scan signal SSb, the upper scan signal SSc, and the lower scan signal SSd from the left scan driving circuit 142*a*, the right scan driving circuit 142*b*, the upper scan driving circuit 142*c*, and the lower scan driving circuit 142*d*, respectively. For example, when a scan operation is performed on the upper region of the display panel 120, the pixels arranged in the upper region of the display panel 120 receive the scan signal SS including the upper scan signal SSc, the left scan signal SSa, and the right scan signal SSb. In addition, when a scan operation is performed on the lower region of the display panel 120, the pixels arranged in the lower region of the display panel 120 can receive the scan signal SS including the lower scan signal SSd, the left scan signal SSa, and the right scan signal SSb. That is, the scan driver 142 can provide the scan signal SS including the upper scan signal SSc, the left scan signal SSa, and the right scan signal SSb or the scan signal SS including ncluding the lower scan signal SSd, the left scan signal SSa, and the right scan signal SSb to the display panel 120. The display panel 120 can be connected to the data driver 143 of the display panel controller 140 via data-lines. The data driver 143 can provide a data signal DS to the display panel 120. The timing controller 141 can generate control signals CTL(1) and CTL(2) to provide the control signals CTL(1) and CTL(2) to the data driver 143 and the scan driver 142. That is, the timing controller 141 can control the data driver 143 and the scan driver 142. In an example embodiment, the timing controller 141 receives image data DATA to generate final image data DATA' by performing a specific data conversion on the image data DATA. For example, the timing controller 141 generates the final image data DATA by performing gamma correction, gamma adjustment, degradation compensation, etc. on the image data DATA. In some example embodiments, the display panel controller 140 further includes the memory device 144 (e.g., a flash memory device, an EEPROM device, etc.) that stores data that are required to perform the specific data conversion (e.g., the gamma correction, the gamma adjustment, the degradation compensation, etc.).

In an example embodiment, in the upper region of the display panel 120, contact points of the first vertical scan-lines and the horizontal scan-lines get farther from the upper-lower symmetry center line HRL of the display panel 120 as the contact points of the first vertical scan-lines and the horizontal scan-lines get farther from the left-right symmetry center line VRL of the display panel 120. For example, when the first vertical scan-lines are connected to the horizontal scan-lines as a pair in the left-right symmetrical shape with respect to the left-right symmetry center line VRL of the display panel 120, the contact points of the first vertical scan-lines and the horizontal scan-lines can get closer to the upper side of the display panel 120 as the contact points of the first vertical scan-lines and the horizontal scan-lines get farther from the left-right symmetry center line VRL. In addition, when the contact points of the first vertical scan-lines and the horizontal scan-lines get closer to the upper side of the display panel 120 as the contact points of the first vertical scan-lines and the horizontal scan-lines get farther from the left-right symmetry center line VRL, the first vertical scan-lines can gradually (or, sequentially) get shorter as the first vertical scan-lines get farther from the left-right symmetry center line VRL of the display panel 120. In example embodiments, the first vertical scan-lines are arranged within a predetermined distance from the left-right symmetry center line VRL. For example, the first vertical scan-lines are arranged near the left-right symmetry center line VRL. In this case, for example, the first vertical scan-lines are not arranged near the left side and the right side of the display panel 120. Meanwhile, since the first vertical scan-lines are connected to the horizontal scan-lines as a pair in the left-right symmetrical shape with respect to the left-right symmetry center line VRL, a pair (i.e., two) of the first vertical scan-lines can be connected to one of the horizontal scan-lines in the upper region of the display panel 120. Thus, the quantity of the first vertical scan-lines can be twice as many as the quantity of the horizontal scan-lines arranged in the Lipper region of the display panel 120.

Similarly, in the lower region of the display panel 120, contact points of the second vertical scan-lines and the horizontal scan-lines can get farther from the upper-lower symmetry center line HRL of the display panel 120 as the contact points of the second vertical scan-lines and the horizontal scan-lines get farther from the left-right symmetry center line VRL. For example, when the second vertical scan-lines are connected to the horizontal scan-lines as a pair in the left-right symmetrical shape with respect to the left-right symmetry center line VRL, the contact points of the second vertical scan-lines and the horizontal scan-lines can get closer to the lower side of the display panel 120 as the contact points of the second vertical scan-lines and the horizontal scan-lines get farther from the left-right symmetry center line VRL of the display panel 120. In addition, when the contact points of the second vertical scan-lines and the horizontal scan-lines get closer to the lower side of the display panel 120 as the contact points of the second vertical scan-lines and the horizontal scan-lines get farther from the left-right symmetry center line VRL, the second vertical scan-lines can gradually (or, sequentially) get shorter as the second vertical scan-lines get farther from the left-right symmetry center line VRL. In example embodiments, the second vertical scan-lines are arranged within a predetermined distance from the left-right symmetry center line VRL of the display panel 120. For example, the second vertical scan-lines are arranged near the left-right symmetry center line VRL of the display panel 120. In this case, the second vertical scan-lines are not arranged near the left side and the right side of the display panel 120. Meanwhile, since the second vertical scan-lines are connected to the horizontal scan-lines as a pair in a left-right symmetrical shape with respect to, the left-right symmetry center line VRL, a pair (i.e., two) of the second vertical scan-lines can be connected to one of the horizontal scan-lines in the lower region of the display panel 120. Thus, the quantity of the second vertical scan-lines can be twice as many as the quantity of the horizontal scan-lines arranged in the lower region of the display panel 120. Therefore, in the display panel 120, the contact points of the first vertical scan-lines and the horizontal scan-lines can be horizontally symmetrical to the contact points of the second vertical scan-lines and the horizontal scan-lines with respect to the upper-lower symmetry center line HRL of the display panel 120.

In another example embodiment, in the upper region of the display panel 120, the contact points of the first vertical scan-lines and the horizontal scan-lines can get closer to the upper-lower symmetry center line HRL of the display panel 120 as the contact points of the first vertical scan-lines and the horizontal scan-lines get farther from the left-right symmetry center line VRL. For example, when the first vertical scan-lines are connected to the horizontal scan-lines as a pair in the left-right symmetrical shape with respect to the left-right symmetry center line VRL, the contact points of the first vertical scan-lines and the horizontal scan-lines can get farther from the upper side of the display panel 120 as the contact points of the first vertical scan-lines and the horizontal scan-lines get farther from the left-right symmetry center line VRL. In addition, when the contact points of the first vertical scan-lines and the horizontal scan-lines get farther from the upper side of the display panel 120 as the contact points of the first vertical scan-lines and the horizontal scan-lines get farther from the left-right symmetry center line VRL, the first vertical scan-lines can gradually (or, sequentially) get longer as the first vertical scan-lines get farther from the left-right symmetry center line VRL. In example embodiments, the first vertical scan-lines are arranged within a predetermined distance from the left-right symmetry center line VRL. For example, the first vertical scan-lines are arranged near the left-right symmetry center line VRL of the display panel 120. In this case, the first vertical scan-lines are not arranged near the left side and the right side of the display panel 120. Meanwhile, since the first vertical scan-lines are connected to the horizontal scan-lines as a pair in the left-right symmetrical shape with respect to the left-right symmetry center line VRL, a pair (i.e., two) of the first vertical scan-lines can be connected to one of the horizontal scan-lines in the upper region of the display panel 120. Thus, the quantity of the first vertical scan-lines can be twice as many as the quantity of the horizontal scan-lines arranged in the upper region of the display panel 120.

Similarly, in the lower region of the display panel 120, the contact points of the second vertical scan-lines and the horizontal scan-lines can get closer to the upper-lower symmetry center line HRL as the contact points of the second vertical scan-lines and the horizontal scan-lines get farther from the left-right symmetry center line VRL of the display panel 120. For example, when the second vertical scan-lines are connected to the horizontal scan-lines as a pair in the left-right symmetrical shape with respect to the left-right symmetry center line VRL, the contact points of the second vertical scan-lines and the horizontal scan-lines can get farther from the lower side of the display panel 120 as the contact points of the second vertical scan-lines and the horizontal scan-lines get farther from the left-right symmetry center line VRL. In addition, when the contact points of the second vertical scan-lines and the horizontal scan-lines get farther from the lower side of the display panel 120 as the contact points of the second vertical scan-lines and the horizontal scan-lines get farther from the left-right symmetry center line VRL, the second vertical scan-lines can gradually (or, sequentially) get longer as the second vertical scan-lines get farther from the left-right symmetry center line VRL of the display panel 120. In example embodiments, the second vertical scan-lines are arranged within a predetermined distance from the left-right symmetry center line VRL. For example, the second vertical scan-lines are arranged near the left-right symmetry center line VRL. In this case, the second vertical scan-lines are not arranged near the left side and the right side of the display panel 120. Meanwhile, since the second vertical scan-lines are connected to the horizontal scan-lines as a pair in the left-right symmetrical shape with respect to the left-right symmetry center line VRL, a pair (i.e., two) of the second vertical scan-lines can be connected to one of the horizontal scan-lines in the lower region of the display panel 120. Thus, the quantity of the second vertical scan-lines can be twice as many as the quantity of the horizontal scan-lines arranged in the lower region of the display panel 120. Therefore, in the display panel 120, the contact points of the first vertical scan-lines and the horizontal scan-lines can be horizontally symmetrical to the contact points of the second vertical scan-lines and the horizontal scan-lines with respect to the upper-lower symmetry center line HRL of the display panel 120.

The display device 100 can include the upper scan driving circuit 142*c* located near the upper side of the display panel 120, which provides the upper scan signal SSc to the upper region of the display panel 120 via the first vertical scan-lines, the lower scan driving circuit 142*d* located near the lower side of the display panel 120, which provides the lower scan signal SSd to the lower region of the display panel 120 via the second vertical scan-lines, the left scan driving circuit 142*a* located near the left side of the display panel 120, which provides the left scan signal SSa to the display panel 120 via the horizontal scan-lines, and the right scan driving circuit 142*b* located near the right side of the display panel 120, which provides the right scan signal SSb to the display panel 120 via the horizontal scan-lines. In the upper region of the display panel 120, the first vertical scan-lines can be connected to the horizontal scan-lines as a pair in the left-right symmetrical shape with respect to the left-right symmetry center line VRL. In the lower region of the display panel 120, the second vertical scan-lines can be connected to the horizontal scan-lines as a pair in the left-right symmetrical shape with respect to the left-right symmetry center line VRL. As a result, the display device 100 can minimize (or, reduce) interference among the scan-lines as well as prevent an RC delay of the scan signal SS provided via the scan-lines by efficiently arranging the scan-lines in the display panel 120. For example, when a plurality of lines extending from the left side of the display panel 120 to the right side of the display panel 120 are defined as row-lines and a plurality of lines extending from the upper side of the display panel 120 to the lower side of the display panel 120 are defined as column-lines, a maximum point of the RC delay of the scan signal SS can be a row-line (i.e., the horizontal scan-line) located at a center of the display panel 120. However, in the display device 100, since the row-line located at the center of the display panel 120 is not crossed by vertical scan-lines other than vertical scan-lines connected to the row-line located at the center of the display panel 120, the RC delay of the scan signal SS can be minimized at the row-line located at the center of the display panel 120. Thus, the display device 100 can efficiently reduce (or, prevent) deviation of the RC delay between the row-lines in the display panel 120.

Figure 4:
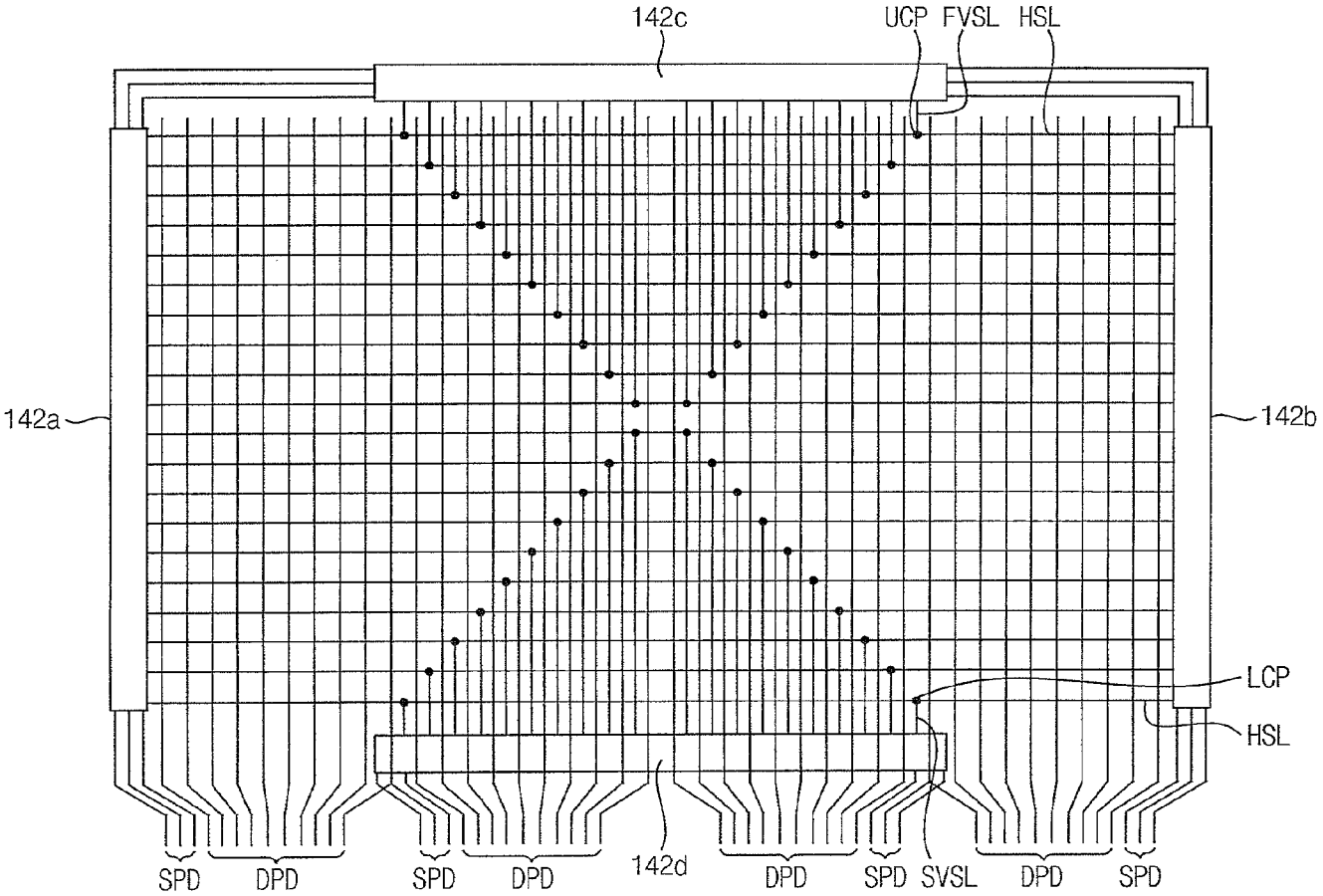
FIG. 4 is a diagram illustrating an example in which vertical scan-lines are connected to horizontal scan-lines in a display panel of the display device of FIG. 1.

FIG. 4 is a diagram illustrating an example in which vertical scan-lines are connected to horizontal scan-lines in a display panel of the display device of FIG. 1.

Referring to FIG. 4, the scan driver 142 includes the left scan driving circuit 142*a*, the right scan driving circuit 142*b*, the upper scan driving circuit 142*c*, and the lower scan driving circuit 142*d*. The scan driver 142 can receive a scan driving control signal via scan driving input pads SPD and can generate a scan signal based on the scan driving control signal to provide the scan signal to the display panel 120. For example, as illustrated in FIG. 4, the left scan driving circuit 142*a*, the right scan driving circuit 142*b*, and the lower scan driving circuit 142*d* receive the scan driving control signal via the scan driving input pads SPD. Also, referring to FIG. 4, the upper scan driving circuit 142*c* receives the scan driving control signal via the left scan driving circuit 142*a* and the right scan driving circuit 142*b*. However, since the scan driver 142 illustrated in FIG. 4 is an example, a structure of the scan driver 142 is not limited thereto. For example, the upper scan driving circuit 142*c* can be divided into a left-upper scan driving circuit and a right-upper scan driving circuit by the left-right symmetry center line VRL of the display panel 120, and the lower scan driving circuit 142*d* can be divided into a left-lower scan driving circuit and a right-lower scan driving circuit by the left-right symmetry center line VRL of the display panel 120. Meanwhile, a data signal can be provided to the display panel 120 via data input pads DPD. As described above, in the display device 100, the upper scan driving circuit 142*c* can perform a scan operation on the upper region of the display panel 120, and the lower scan driving circuit 142*d* can perform a scan operation on the lower region of the display panel 120. For example, when the display device 100 is an ultra high definition (UHD) display device, the display panel 120 can include 3840 pixel-columns and 2160 pixel-rows. Thus, the upper scan driving circuit 142*c* can perform a scan operation on 1080 pixel-rows that are located in the upper region of the display panel 120, and the lower scan driving circuit 142*d* can perform a scan operation on 1080 pixel-rows that are located in the lower region of the display panel 120.

Specifically, in the upper region of the display panel 120, the contact points UCP of the first vertical scan-lines FVSL and the horizontal scan-lines HSL can get farther from the upper-lower symmetry center line HRL as the contact points UCP of the first vertical scan-lines FVSL and the horizontal scan-lines HSL get farther from the left-right symmetry center line VRL. That is, in the upper region of the display panel 120, the contact points UCP of the first vertical scan-lines FVSL and the horizontal scan-lines HSL can get closer to the upper side of the display panel 120 as the contact points UCP of the first vertical scan-lines FVSL and the horizontal scan-lines HSL get farther from the left-right symmetry center line VRL. Here, the first vertical scan-lines FVSL can gradually (or, sequentially) get shorter as the first vertical scan-lines FVSL get farther from the left-right symmetry center line VRL. In example embodiments, as illustrated in FIG. 4, the first vertical scan-lines FVSL are arranged within a predetermined distance from the left-right symmetry center line VRL. For example, the first vertical scan-lines FVSL are arranged near the left-right symmetry center line VRL of the display panel 120. Meanwhile, since the first vertical scan-lines FVSL are connected to the horizontal scan-lines HSL as a pair in a left-right symmetrical shape with respect to the left-right symmetry center line VRL of the display panel 120, a pair (i.e., two) of the first vertical scan-lines FVSL can be connected to one of the horizontal scan-lines HSL in the upper region of the display panel 120. Thus, the quantity of the first vertical scan-lines FVSL can be twice as many as the quantity of the horizontal scan-lines HSL arranged in the upper region of the display panel 120. Similarly, in the lower region of the display panel 120, the contact points LCP of the second vertical scan-lines SVSL and the horizontal scan-lines HSL can get farther from the upper-lower symmetry center line HRL as the contact points LCP of the second vertical scan-lines SVSL and the horizontal scan-lines HSL get farther from the left-right symmetry center line VRL. That is, in the lower region of the display panel 120, the contact points LCP of the second vertical scan-lines SVSL and the horizontal scan-lines HSL can get closer to the lower side of the display panel 120 as the contact points LCP of the second vertical scan-lines SVSL and the horizontal scan-lines HSL get farther from the left-right symmetry center line VRL. Here, the second vertical scan-lines SVSL can gradually (or, sequentially) get shorter as the second vertical scan-lines SVSL get farther from the left-right symmetry center line VRL. In example embodiments, as illustrated in FIG. 4, the second vertical scan-lines SVSL are arranged within a predetermined distance from the left-right symmetry center line VRL of the display panel 120. For example, the second vertical scan-lines SVSL can be arranged near the left-right symmetry center line VRL. Meanwhile, since the second vertical scan-lines SVSL are connected to the horizontal scan-lines HSL as a pair in a left-right symmetrical shape with respect to the left-right symmetry center line VRL of the display panel 120, a pair (i.e., two) of the second vertical scan-lines SVSL can be connected to one of the horizontal scan-lines HSL in the lower region of the display panel 120. Thus, the quantity of the second vertical scan-lines SVSL can be twice as many as the quantity of the horizontal scan-lines HSL arranged in the lower region of the display panel 120. Therefore, in the display panel 120, the contact points UCP of the first vertical scan-lines FVSL and the horizontal scan-lines HSL can be horizontally symmetrical to the contact points LCP of the second vertical scan-lines SVSL and the horizontal scan-lines HSL with respect to the upper-lower symmetry center line HRL of the display panel 120.

Figure 5:
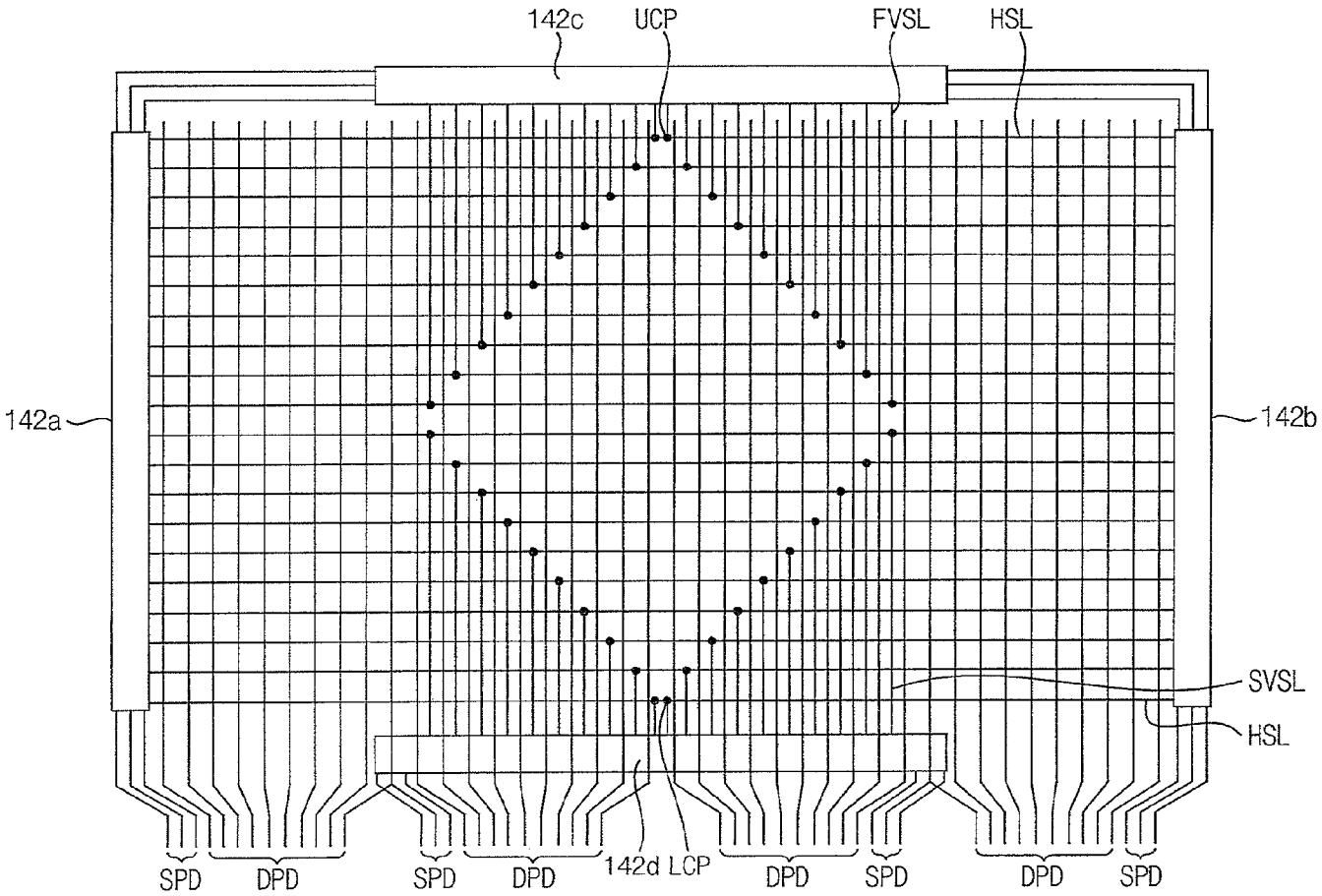
FIG. 5 is a diagram illustrating another example in which vertical scan-lines are connected to horizontal scan-lines in a display panel of the display device of FIG. 1.

FIG. 5 is a diagram illustrating another example in which vertical scan-lines are connected to horizontal scan-lines in a display panel of the display device of FIG. 1.

Referring to FIG. 5, the scan driver 142 includes the left scan driving circuit 142*a*, the right scan driving circuit 142*b*, the upper scan driving circuit 142*c*, and the lower scan driving circuit 142*d*. The scan driver 142 can receive a scan driving control signal via scan driving input pads SPD and can generate a scan signal based on the scan driving control signal to provide the scan signal to the display panel 120. For example, as illustrated in FIG. 5, the left scan driving circuit 142*a*, the right scan driving circuit 142*b*, and the lower scan driving circuit 142*d* receive the scan driving control signal via the scan driving input pads SPD, and the upper scan driving circuit 142*c* receives the scan driving control signal via the left scan driving circuit 142*a* and the right scan driving circuit 142*b*. However, since the scan driver 142 illustrated in FIG. 5 is an example, a structure of the scan driver 142 is not limited thereto. For example, the upper scan driving circuit 142*c* can be divided into a left-upper scan driving circuit and a right-upper scan driving circuit by the left-right symmetry center line VRL, and the lower scan driving circuit 142*d* can be divided into a left-lower scan driving circuit and a right-lower scan driving circuit by the left-right symmetry center line VRL. Meanwhile, a data signal can be provided to the display panel 120 via data input pads DPD. As described above, in the display device 100, the upper scan driving circuit 142*c* can perform a scan operation on the upper region of the display panel 120, and the lower scan driving circuit 142*d* can perform a scan operation on the lower region of the display panel 120. For example, when the display device 100 is an UHD display device, the display panel 120 includes 3840 pixel-columns and 2160 pixel-rows. Thus, the upper scan driving circuit 142*c* can perform a scan operation on 1080 pixel-rows that are located in the upper region of the display panel 120, and the lower scan driving circuit 142*d* can perform a scan operation on 1080 pixel-rows that are located in the lower region of the display panel 120.

In some embodiments, in the upper region of the display panel 120, the contact points UCP of the first vertical scan-lines FVSL and the horizontal scan-lines HSL get closer to the upper-lower symmetry center line HRL as the contact points UCP of the first vertical scan-lines FVSL and the horizontal scan-lines HSL get farther from the left-right symmetry center line VRL. That is, in the upper region of the display panel 120, the contact points UCP of the first vertical scan-lines FVSL and the horizontal scan-lines HSL can get farther from the upper side of the display panel 120 as the contact points UCP of the first vertical scan-lines FVSL and the horizontal scan-lines HSL get farther from the left-right symmetry center line VRL. Here, the first vertical scan-lines FVSL can gradually (or, sequentially) get longer as the first vertical scan-lines FVSL get farther from the left-right symmetry center line VRL. In example embodiments, as illustrated in FIG. 5, the first vertical scan-lines FVSL are arranged within a predetermined distance from the left-right symmetry center line VRL. For example, the first vertical scan-lines FVSL are arranged near the left-right symmetry center line VRL. Meanwhile, since the first vertical scan-lines FVSL are connected to the horizontal scan-lines HSL as a pair in a left-right symmetrical shape with respect to the left-right symmetry center line VRL, a pair (i.e., two) of the first vertical scan-lines FVSL can be connected to one of the horizontal scan-lines HSL in the upper region of the display panel 120. Thus, the quantity of the first vertical scan-lines FVSL can be twice as many as the quantity of the horizontal scan-lines HSL arranged in the upper region of the display panel 120. Similarly, in the lower region of the display panel 120, the contact points LCP of the second vertical scan-lines SVSL and the horizontal scan-lines HSL can get closer to the upper-lower symmetry center line HRL of the display panel 120 as the contact points LCP of the second vertical scan-lines SVSL and the horizontal scan-lines HSL get farther from the left-right symmetry center line VRL. That is, in the lower region of the display panel 120, the contact points LCP of the second vertical scan-lines SVSL and the horizontal scan-lines HSL can get farther from the lower side of the display panel 120 as the contact points LCP of the second vertical scan-lines SVSL and the horizontal scan-lines HSL get farther from the left-right symmetry center line VRL. Here, the second vertical scan-lines SVSL can gradually (or, sequentially) get longer as the second vertical scan-lines SVSL get farther from the left-right symmetry center line VRL. In example embodiments, as illustrated in FIG. 5, the second vertical scan-lines SVSL are arranged within a predetermined distance from the left-right symmetry center line VRL. For example, the second vertical scan-lines SVSL can be arranged near the left-right symmetry center line VRL. Meanwhile, since the second vertical scan-lines SVSL are connected to the horizontal scan-lines HSL as a pair in the left-right symmetrical shape with respect to the left-right symmetry center line VRL, a pair (i.e., two) of the second vertical scan-lines SVSL can be connected to one of the horizontal scan-lines HSL in the lower region of the display panel 120. Thus, the quantity of the second vertical scan-lines SVSL can be twice as many as the quantity of the horizontal scan-lines HSL arranged in the lower region of the display panel 120. Therefore, in the display panel 120, the contact points UCP of the first vertical scan-lines FVSL and the horizontal scan-lines HSL can be horizontally symmetrical to the contact points LCP of the second vertical scan-lines SVSL and the horizontal scan-lines HSL with respect to the upper-lower symmetry center line HRL.

Figure 6:
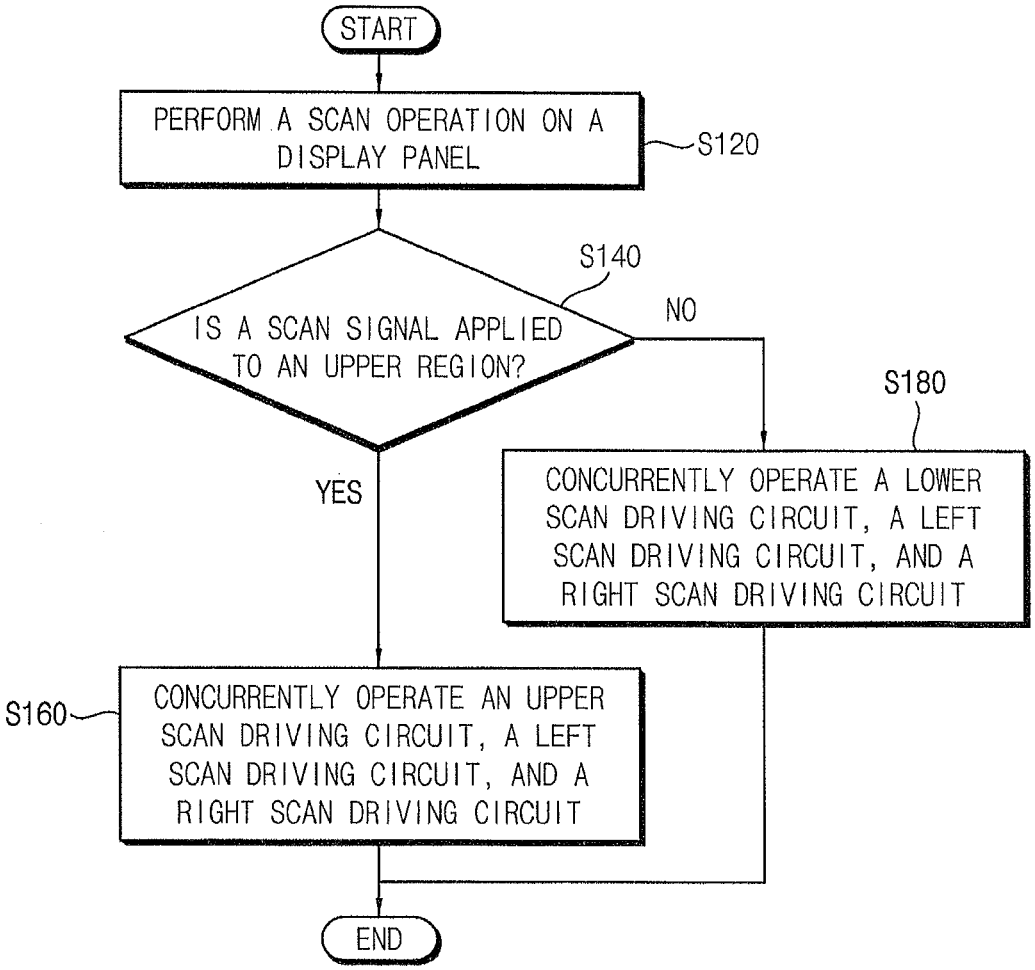
FIG. 6 is a flowchart illustrating an example in which a scan driver operates in the display device of FIG. 1.

FIG. 6 is a flowchart illustrating an example in which a scan driver operates in the display device of FIG. 1. In some embodiments, the FIG. 6 procedure is implemented in a conventional programming language, such as C or C++ or another suitable programming language. The program can be stored on a computer accessible storage medium of the display device 100, for example, a memory device 144 of the display device 100, display panel controller 140, or the timing controller 141. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9x/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 6.

Figure 7A:
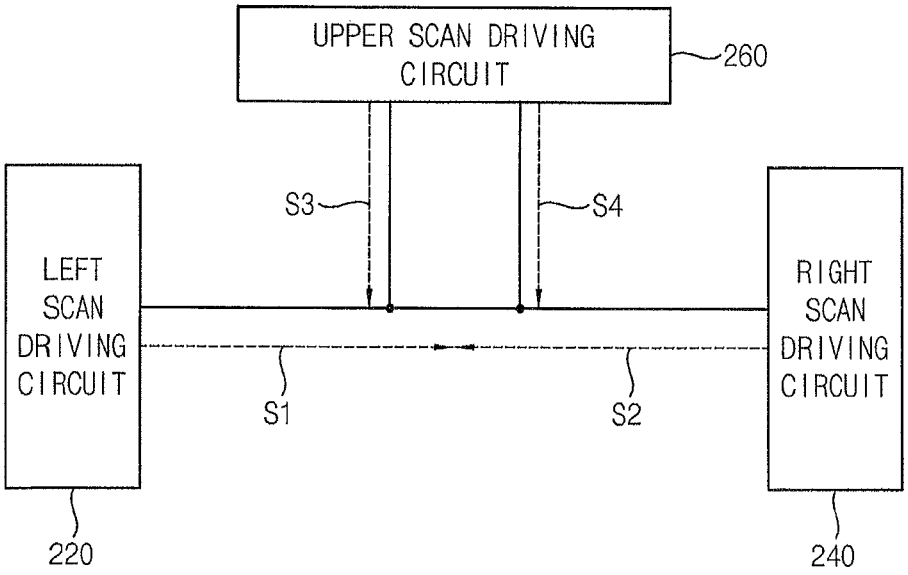
FIG. 7A is a diagram illustrating an example in which a scan signal is provided at an upper region of a display panel in the display device of FIG. 1.
Figure 7B:
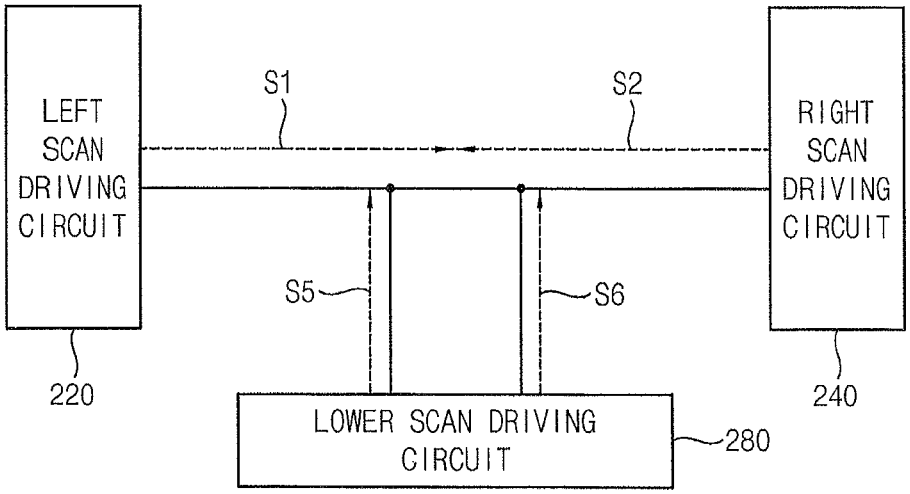
FIG. 7B is a diagram illustrating an example in which a scan signal is provided at a lower region of a display panel in the,display device of FIG. 1.

FIG. 7A is a diagram illustrating an example in which a scan signal is provided at an upper region of a display panel in the display device of FIG. 1. FIG. 7B is a diagram illustrating an example in which a scan signal is provided at a lower region of a display panel in the display device of FIG. 1.

Referring to FIGS. 6 through 7B, the scan driver includes the left scan driving circuit 220 located near the left side of the display panel, which provides the left scan signal S1 to the display panel via the horizontal scan-lines, the right scan driving circuit 240 located near the right side of the display panel, which provides the right scan signal S2 to the display panel via the horizontal scan-lines, the upper scan driving circuit 260 located near the upper side of the display panel, which provides the upper scan signal S3 and S4 to the upper region of the display panel via the first vertical scan-lines, and the lower scan driving circuit 280 located near the lower side of the display panel, which provides the lower scan signal S5 and S6 to the lower region of the display panel via the second vertical scan-lines. The scan driver can perform a scan operation on the display panel (S 120) and can check whether a scan signal is to be applied to the upper region of the display panel (S140). As illustrated in FIG. 7A, when the scan signal is to be applied to the upper region of the display panel, the scan driver concurrently operates the upper scan driving circuit 260, the left scan driving circuit 220, and the right scan driving circuit 240 (S 160). As a result, a plurality of pixels located in the upper region of the display panel can receive the scan signal including the upper scan signal S3 and S4, the left scan signal S1, and the right scan signal S2 via the horizontal scan-lines and the first vertical scan-lines. Thus, the scan driver can minimize (or, reduce) an RC delay of the scan signal when the scan signal is applied to the pixels that are connected to one horizontal scan-line in the upper region of the display panel. On the other hand, as illustrated in FIG. 7B, when the scan signal is to be applied to the lower region of the display panel, the scan driver concurrently operates the lower scan driving circuit 280, the left scan driving circuit 220, and the right scan driving circuit 240 (S 180). As a result, a plurality of pixels located in the lower region of the display panel can receive the scan signal including the lower scan signal S5 and S6, the left scan signal S1, and the right scan signal S2 via the horizontal scan-lines and the second vertical scan-lines. Thus, the scan driver can minimize (or, reduce) the RC delay of the scan signal when the scan signal is applied to the pixels that are connected to one horizontal scan-line in the lower region of the display panel. As described above, in the upper region of the display panel, the first vertical scan-lines can be connected to the horizontal scan-lines as a pair in the left-right symmetrical shape with respect to the left-right symmetry center line of the display panel. Additionally, in the lower region of the display panel, the second vertical scan-lines can be connected to the horizontal scan-lines as a pair in the left-right symmetrical shape with respect to the left-right symmetry center line of the display panel. Accordingly, the scan-lines can be efficiently arranged in the display panel. As a result, in the display panel, deviation of the RC delay between the scan-lines can be minimized (or, reduced) because interference among the scan-lines is minimized (or, reduced).

Figure 8:
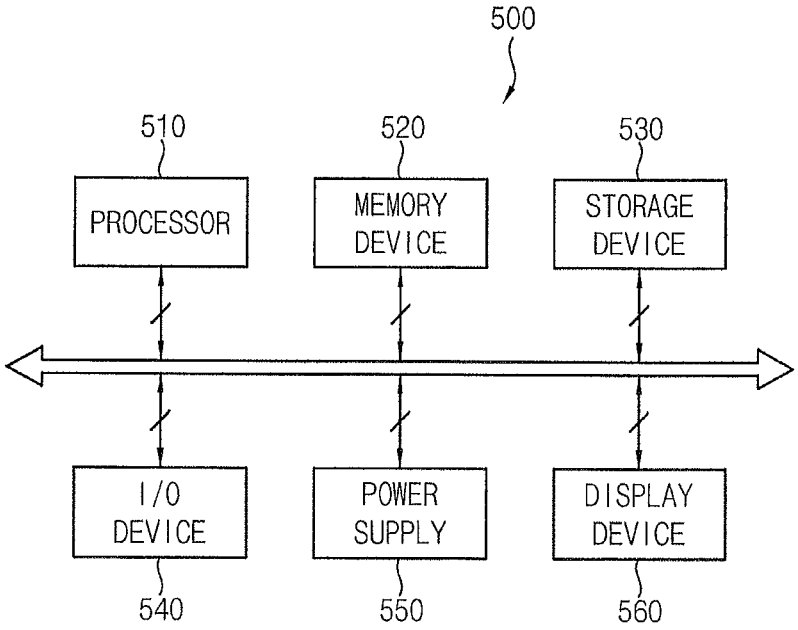
FIG. 8 is a block diagram illustrating an electronic device according to example embodiments.
Figure 9:
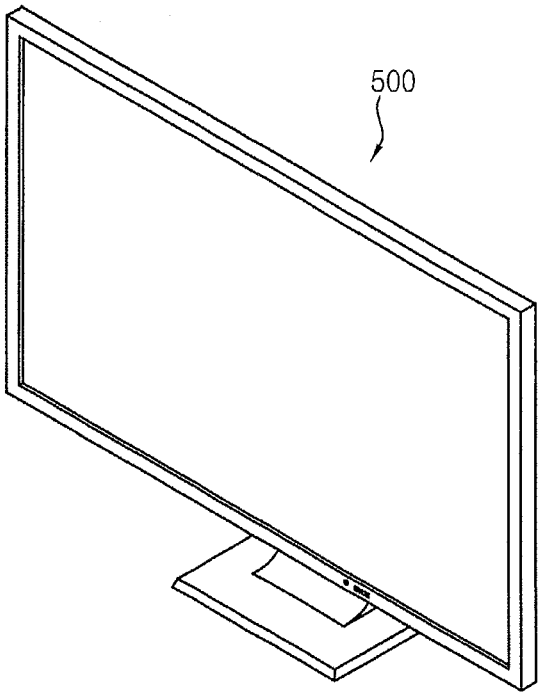
FIG. 9 is a diagram illustrating an example in which the electronic device of FIG. 8 is implemented as a television.
Figure 10:
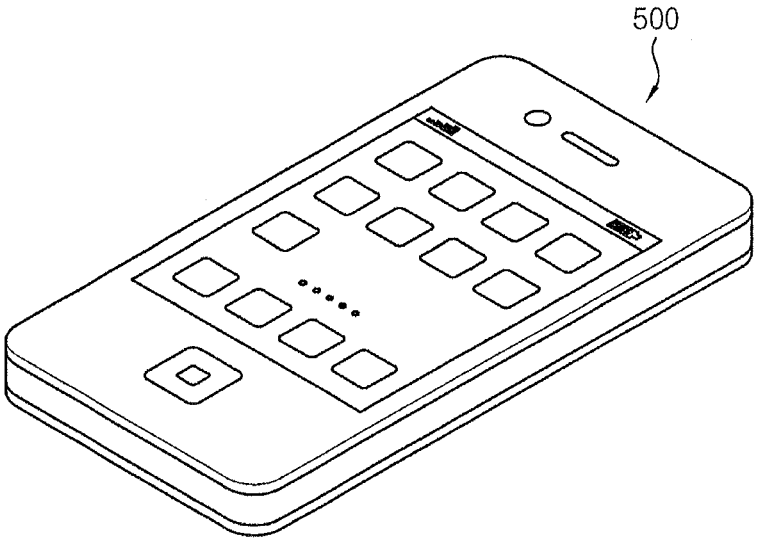
FIG. 10 is a diagram illustrating an example in which the electronic device of FIG. 8 is implemented as a smartphone.

FIG. 8 is a block diagram illustrating an electronic device according to example embodiments. FIG. 9 is a diagram illustrating an example in which the electronic device of FIG. 8 is implemented as a television. FIG. 10 is a diagram illustrating an example in which the electronic device of FIG. 8 is implemented as a smartphone.

Referring to FIGS. 8 through 10, the electronic device 500 includes a processor 510, a memory device 520, a storage device 530, an input/output (I/O) device 540, a power supply 550, and a display device 560. Here, the display device 560 can correspond to the display device 100 of FIG. 1. In addition, the electronic device 500 can further include a plurality of ports for communicating with a video card, a sound card, a memory card, a universal serial bus (USB) device, other electronic devices, etc. In an example embodiment, as illustrated in FIG. 9, the electronic device 500 is implemented as a television. In another example embodiment, as illustrated in FIG. 10, the electronic device 500 is implemented as a smartphone. However, the electronic device 500 is not limited thereto. For example, the electronic device 500 can be implemented as a cellular phone, a video phone, a smart tablet, a tablet computer, a car navigation system, a computer monitor, a laptop computer, a head mounted display (HMD), etc.

The processor 510 can perform various computing functions. The processor 510 can be a microprocessor, a central processing unit (CPU), an application processor (AP), etc. The processor 510 can be coupled to other components via an address bus, a control bus, a data bus, etc. Further, the processor 510 can be coupled to an extended bus such as a peripheral component interconnection (PCI) bus. The memory device 520 can store data for operations of the electronic device 500. For example, the memory device 520 includes at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 530 can be a solid state drive (SSD) device, a hard disk drive (HDD) device, a CD-ROM device, etc.

The I/O device 540 can include an input device such as a keyboard, a keypad, a mouse device, a touchpad, a touch-screen, etc. and an output device such as a printer, a speaker, etc. The power supply 550 can provide power for operations of the electronic device 500. In some example embodiments, the display device 560 is included in the I/O device 540. The display device 560 can be coupled to other components via the buses or other communication links.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device, comprising:

a display panel;

a scan driver configured to provide a plurality of scan signals to the display panel via a plurality of scan-lines, wherein the scan signals include upper, lower, left and right scan signals, and wherein the scan-lines include first and second vertical scan-lines, and first and second horizontal scan-lines respectively arranged in upper and lower regions of the display panel;

a data driver configured to provide a plurality of data signals to the display panel; and a timing controller configured to control the scan driver and data driver, wherein the scan driver includes:

an upper scan driving circuit located adjacent to an upper side of the display panel and configured to provide the upper scan signal to an upper region of the display panel via the first vertical scan-lines;

a lower scan driving circuit located adjacent to a lower side of the display panel and configured to provide the lower scan signal to a lower region of the display panel via the second vertical scan-lines;

a left scan driving circuit located adjacent to a left side of the display panel and configured to provide the left scan signal to the display panel via the first and second horizontal scan-lines; and a right scan driving circuit located adjacent to a right side of the display panel and configured to provide the right scan signal to the display panel via the first and second horizontal scan-lines, wherein the first vertical scan-lines are connected to the first and second horizontal scan-lines and are symmetrical with respect to a left-right symmetry center line of the display panel, and wherein the second vertical scan-lines are connected to the first and second horizontal scan-lines and are symmetrical with respect to the left-right symmetry center line of the display panel.

2. The display device of claim 1, wherein the display panel includes a first group of pixels located in the upper region of the display panel and configured to receive the upper, left and right scan signals when a first scan operation is performed on the upper region of the display panel, and wherein the display panel further includes a second group of pixels located in the lower region of the display panel and configured to receive the lower, left and right scan signals when a second scan operation is performed on the lower region of the display panel.

3. The display device of claim 2, wherein the intersection of the first vertical scan-lines and the first and second horizontal scan-lines form first contact points, and wherein the first contact points are located farther from an upper-lower symmetry center line of the display panel as the first contact points are located farther from the left-right symmetry center line of the display panel.

4. The display device of claim 3, wherein the first vertical scan-lines become shorter as the first vertical scan-lines are located farther from the left-right symmetry center line of the display panel.

5. The display device of claim 3, wherein the first vertical scan-lines are located within a predetermined distance from the left-right symmetry center line of the display panel.

6. The display device of claim 3, wherein the number of the first vertical scan-lines is twice as many as the number of the first horizontal scan-lines.

7. The display device of claim 3, wherein the intersection of the second vertical scan-lines and the first and second horizontal scan-lines form second contact, and wherein the second contact points are located farther from the upper-lower symmetry center line of the display panel as the second contact points are located farther from the left-right symmetry center line of the display panel.

8. The display device of claim 7, wherein the second vertical scan-lines become shorter as the second vertical scan-lines are located farther from the left-right symmetry center line of the display panel.

9. The display device of claim 7, wherein the second vertical scan-lines are located within a predetermined distance from the left-right symmetry center line of the display panel.

10. The display device of claim 7, wherein the number of the second vertical scan-lines is twice as many as the number of the second horizontal scan-lines.

11. The display device of claim 7, wherein the first and second contact points are symmetrical to each other with respect to the upper-lower symmetry center line of the display panel.

12. The display device of claim 2, wherein the intersection of the first vertical scan-lines and the first and second horizontal scan-lines form first contact points, and wherein the first contact points are located closer to an upper-lower symmetry center line of the display panel as the first contact points are located farther from the left-right symmetry center line of the display panel.

13. The display device of claim 12, wherein the first vertical scan-lines become longer as the first vertical scan-lines are located farther from the left-right symmetry center line of the display panel.

14. The display device of claim 12, wherein the first vertical scan-lines are located within a predetermined distance from the left-right symmetry center line of the display panel.

15. The display device of claim 12, wherein the number of the first vertical scan-lines is twice as many as the number of the first horizontal scan-lines.

16. The display device of claim 12, wherein the intersection of the second vertical scan-lines and the first and second horizontal scan-lines form second contact points, and wherein the second contact points are located closer to the upper-lower symmetry center line of the display panel as the second contact points are located farther from the left-right symmetry center line of the display panel.

17. The display device of claim 16, wherein the second vertical scan-lines are formed longer as the second vertical scan-lines are located farther from the left-right symmetry center line of the display panel.

18. A display device, comprising:

a display panel;

a scan driver configured to provide a plurality of scan signals to the display panel via a plurality of scan-lines, wherein the scan signals include upper, lower, left and right scan signals, and wherein the scan-lines include first and second vertical scan-lines and horizontal scan-lines;

a data driver configured to provide a plurality of data signals to the display panel; and a timing controller configured to control the scan driver and data driver, wherein the scan driver includes:

a first scan driving circuit configured to provide the upper scan signal to an upper region of the display panel via the first vertical scan-lines;

a second scan driving circuit configured to provide the lower scan signal to a lower region of the display panel via the second vertical scan-lines;

a third scan driving circuit configured to provide the left scan signal to the display panel via the horizontal scan-lines; and a fourth scan driving circuit configured to provide the right scan signal to the display panel via the horizontal scan-lines, wherein the first vertical scan-lines are connected to the horizontal scan-lines and are symmetrical with respect to a left-right symmetry center line of the display panel, and wherein the second vertical scan-lines are connected to the horizontal scan-lines and are symmetrical with respect to the left-right symmetry center line of the display panel.

19. The display device of claim 18, wherein the first to fourth scan driving circuits respectively include upper, lower, left and right scan driving circuits.

20. The display device of claim 19, wherein the first scan driving circuit is located adjacent to an upper side of the display panel, wherein the second scan driving circuit is located adjacent to a lower side of the display panel, wherein the third scan driving circuit is located adjacent to a left side of the display panel, and wherein the fourth scan driving circuit is located adjacent to a right side of the display panel.

* * * * *